United States Patent [19]

Newton

[11] 4,023,809

[45] May 17, 1977

[54] GOLF PRACTISING DEVICE

[76] Inventor: William Chesterfield Newton, 49 Church St., Middle Brighton, Victoria, Australia

[22] Filed: Jan. 22, 1976

[21] Appl. No.: 651,590

[52] U.S. Cl. ..... 273/184 B; 273/200 B

[51] Int. Cl.[2] ..... A63B 69/36

[58] Field of Search ..... 273/184 B, 185 D, 200 R, 273/200 B, 197 R, 185 C

[56] References Cited

UNITED STATES PATENTS

| | | | |
|---|---|---|---|
| 2,641,932 | 6/1953 | Van Kinkle | 273/197 R X |
| 3,031,889 | 5/1962 | Magazanik et al. | 273/200 R |
| 3,666,271 | 5/1972 | Honnef | 273/185 C |

*Primary Examiner*—George J. Marlo
*Attorney, Agent, or Firm*—Donald D. Jeffery

[57] ABSTRACT

The invention relates to a golf practising device wherein a captive ball, upon being struck by a golf club, rotates about a pivot and actuates a drum to wind a cable about the drum against the resistance of a tension member, an indicator movable by the cable to indicate the distance the ball could have travelled if free to complete its flight, and with said indicator arranged to remain in its indicating position after the cable has been unwound from the drum by the tension member and said indicator being readily returnable to normal or zero position.

10 Claims, 7 Drawing Figures

25
33 34
35
12 13
10 11
31
32

25
34
31
35 33
31

25
33
34
13 31
31
35

34
33
35 36
37
36
12 13
31

GOLF PRACTISING DEVICE

This invention relates to a golf practising device of the type where a captive ball is arranged to be struck by a golf club to thereby rotate the ball about a pivot and actuates a recording means to indicate the distance the ball would have travelled if free to complete its flight.

The principal object of the present invention is to provide a golf practising device of the kind referred to of relatively simple construction which will be economical to produce commercially and will provide a readily readable indicated result of a practise stroke and with the indicator readily returnable to zero.

According to the invention, a golf practising device includes a base which may simulate a green, a captive ball secured to a sleeve rotatable on a pillar fixed to the base, a cable winding drum rotatable by said sleeve, a cable anchored to the drum and the free end of a tension member to provide resistance to the winding of the cable on the drum, an indicator movable by the cable in a guideway in said base when the cable is wound upon the drum, and with said indicator arranged to remain in an indicating position after the cable has been unwound from the drum by the tension member. The indicator may be frictionally retained in the indicating position and may be manually returned to normal or zero position.

The anchorage of the cable to the winding drum is preferably arranged so that upon the tension member retracting and returning to normal the ball is automatically returned to the striking position.

The winding drum preferably forms part of the rotatable sleeve although it may be drive-coupled thereto.

In a convenient arrangement the ball is fixed to the free end of an arm integral with the rotatable sleeve and the pillar is inclined towards the "green" at the striking position where the ball is held above the green at a height substantially that of a teed golf ball while the inclined plane of rotation will provide immediately after the ball has been struck a rising flight to the ball simulating that of a free ball struck from a tee.

In order that the invention may be readily understood reference will now be made to the accompanying drawings illustrating one embodiment of a golf practising device constructed in accordance with the invention. In these drawings.

Figures 4, 5, 6, 7:
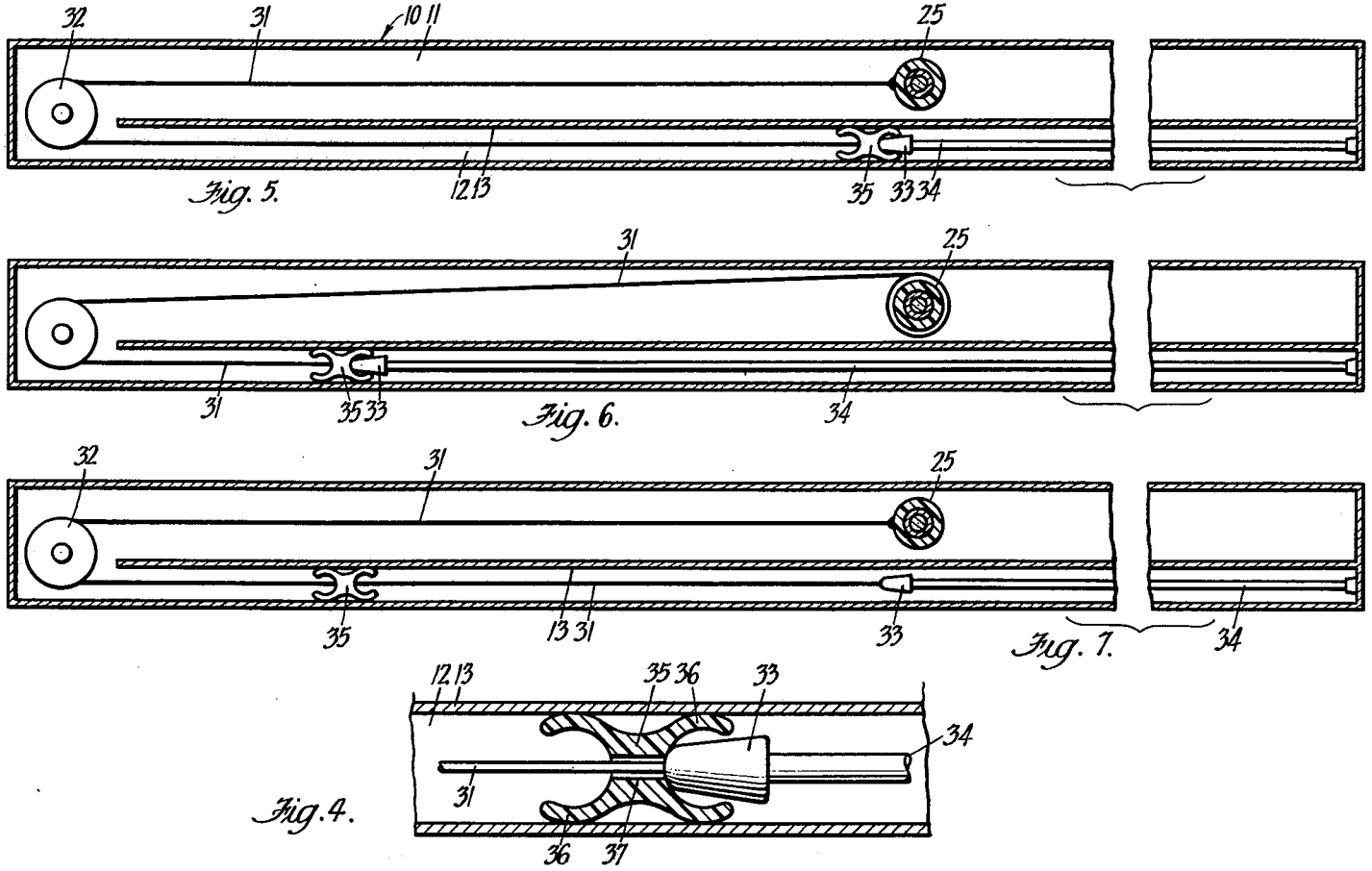

FIG. 4 is a detail section of the indicator and its mounting on the cable in the guideway; and FIGS. 5, 6 and 7 are sectional plan views of that portion of the base of the device carrying the cable winding drum, cable, indicator and tension member, the Figures respectively showing the parts in normal position, the cable wound upon the drum with the position assumed by the indicator, and the indicator in its indicating position after the tension member has unwound the cable on the drum and returned to normal position.

As illustrated the golf practising device comprises a base 8 of suitable rigid material, for example, metal or a rigid plastic moulded in any suitable manner. The base 8 is rectangular in plan and viewed transversely comprises two sections 9 and 10 extending for the length of the base, the front section 9 has a plane upper surface and the rear section 10 is a base section divided into two sections 11 and 12 by a partition 13, the section 11 being larger than section 12. The rear section 10 has a flange 14 extending the length of the rear section 10 and the base 15 of the flange 14 forms a foot on which the rear of the base 8 is adapted to be supported. The foot 15 and forward portion 16 of section 9 is arranged to support the section 10 and front section 9, on a horizontal surface in an inclined manner for the purpose to be hereinafter described.

The upper surface of the forward section 9 has adhered or otherwise secured thereto a length of pile fabric 17 or other material to simulate a portion of turf to represent a green.

The upper surface or web forming the section 11 of the base section 10 is at its centre provided with an aperture 18, through which extends a pillar 19 having a threaded central bore 20 into which a bolt 21 is threaded to secure the pillar to the base web 22 of the section 11. Rotably mounted on the pillar 19 is a sleeve or base 23 which is retained on the pillar 19 by a head 24 formed on said pillar.

The sleeve 23, at the lower end thereof within the section 11, has formed thereon a peripheral recess 25 to form a cable winding drum and the outwardly extending portion of the sleeve 23 has integrally formed thereon an arm 26, the free end of which is cupped, as at 27, to receive a portion of a captive ball 28 which is retained on the end of the arm 26 by a headed bolt 29 screwed into said arm. A nylon or like washer 30 is positioned about the pillar 19 between the lower surface of the sleeve 23 and the base web 22 of the section 11 to provide a reduced friction surface at the end of the sleeve 23 when it is rotated about the pillar 19.

Figures 1, 2, 3:
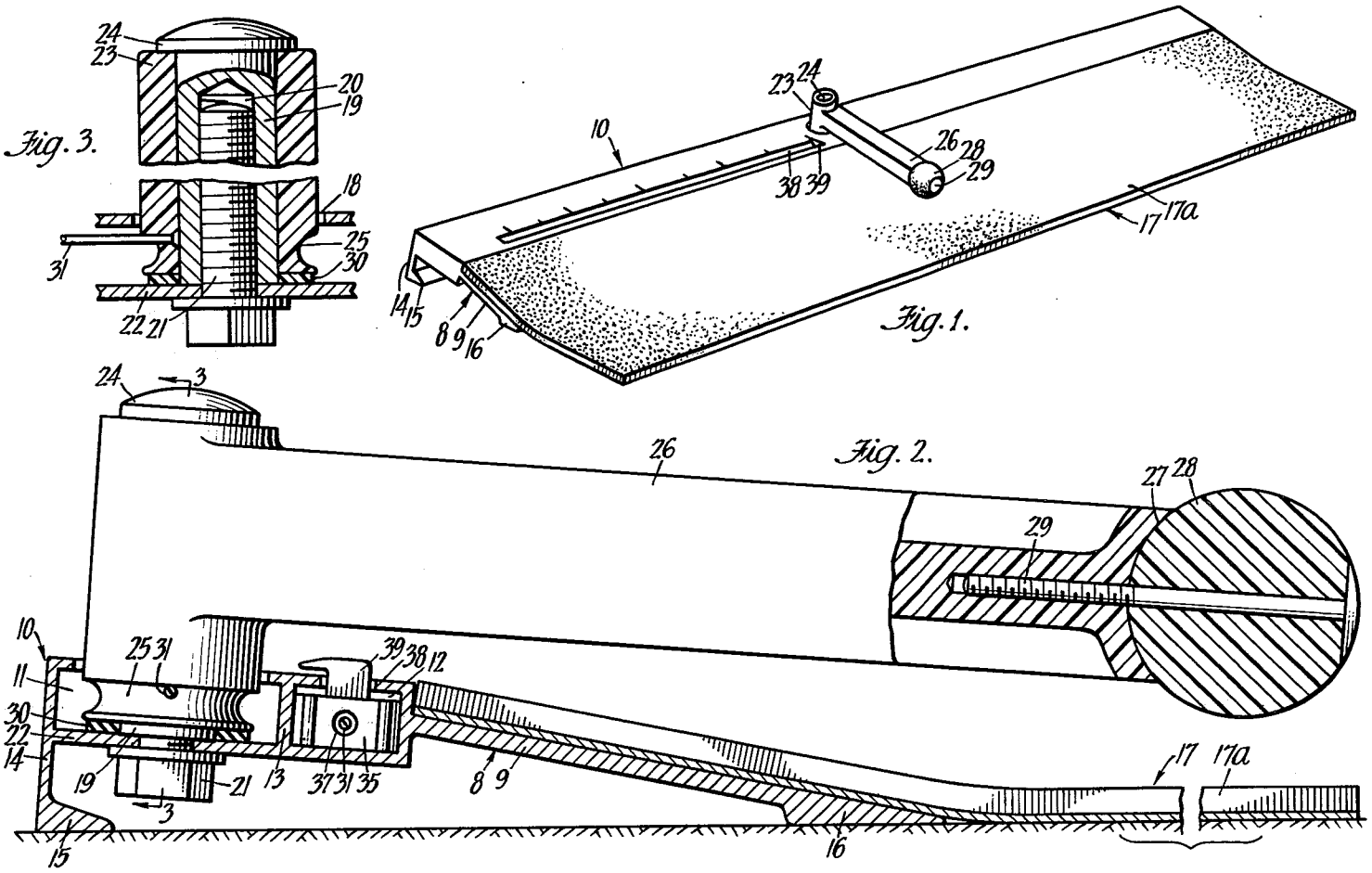
FIG. 1 is a perspective view of the practising device.
FIG. 2 is a part transverse sectional view of the device substantially at the mounting of the captive ball.
FIG. 3 is a section on line 3—3 of FIG. 2.

The inclined arrangement of the sections 10 and 9 and the length of arm 26 is arranged so that said arm rotates about the pillar 19 in a plane inclined to the horizontal and the captive ball 28, when in the normal or striking position shown in FIGS. 1 and 2, is positioned at tee height above the horizontal portion 17*a* of the green 17. With this arrangement the ball 28 upon being struck by a golf club at the tee position will, in commencing to rotate about the pillar, assume a rising flight, simulating that of a free flight ball, and conform with the followthrough motion of the club.

Attached to the winding drum 25, at one side thereof, is the end of a cable 31 which extends along the section 11 (as shown in FIGS. 5, 6 and 7) around return pulley 32 into section 12 where the other end of cable 31, at a point adjacent to the pillar 19, is anchored in block 33 to the free end of a rubber tension member 34, the other end of which is anchored to the end wall of said section 12. The rubber tension member 34 may comprise a helical tension spring if desired.

The section 12 forms a guideway for an indicator member 35, which in plan is substantially of H formation, and is made of a suitable resilient plastic material so that the arms 36 form resilient members frictionally engaging the walls of the section 12 whereby the member 35 will remain in any position it is located in said section. The indicator member 35 has a central aperture 37 through which the cable 31 freely passes and the arrangement is such that upon the cable 31 being wound upon the winding drum 25, against the resistance of the tension member 34, the block 33 moves the indicator member 35 along section 12 according to the distance the tension member is extended by the winding of the cable on the drum.

The upper wall of guideway or section 12 is slotted, as at 38, and through which a pointer 39, forming part of the member 35, extends to register with suitable indicia marked along the slot 38. FIG. 5 shows the winding drum 25, cable 31, tension member 34 and indicator 35 in normal position, FIG. 6 shows the cable wound upon the drum, the tension member extended and having moved the indicator along the guideway and FIG. 7 shows the drum cable and tension member returned to normal leaving the indicator in the registering position from which it may be manually returned to zero or normal position for the next practice shot.

It will be apparent that the embodiment above described requires no modification for right or left handed players as the winding of the cable on the drum to operate the indicator operates irrespective of the direction in which the drum is rotated, that is in the case of a right handed player the captive ball is rotated clockwise and in the case of a left handed player it is rotated anti-clockwise.

Furthermore in the embodiment described the cable winding drum 25 is formed integrally with the sleeve 23 supporting the captive ball for simplicity in construction, however, if desired the winding drum may be separate and drive-coupled to the sleeve by gears or like drive means.

I claim:

1. A golf practising device including a base, a captive ball secured to a sleeve rotatable on a pillar fixed to the base, a cable winding drum rotatable by said sleeve upon the captive ball being struck by a golf club, a cable anchored to the drum and the free end of a tension member to provide resistance to the winding of the cable on the drum, an indicator movable by the cable in a guideway in said base when the cable is wound upon the drum, and with said indicator arranged to remain in an indicating position after the cable has been unwound from the drum by the tension member.

2. A golf practising device as claimed in claim 1 wherein the indicator frictionally engages the guideway to be retained in an indicating position and is manually returnable to a normal or zero position.

3. A golf practising device as claimed in claim 1 wherein the anchorage of the cable to the winding drum is arranged so that upon the tension member retracting and returning to normal, the ball is automatically returned to a striking position.

4. A golf practising device as claimed in claim 1 wherein the winding drum forms part of the rotatable sleeve carrying the captive ball.

5. A golf practising device as claimed in claim 1 wherein the ball is fixed to the free end of an arm integral with the rotatable sleeve and with the pillar inclined towards a striking position where the ball is held at a height substantially that of a teed golf ball.

6. A golf practising device including a rectangular base comprising a front and rear sections extending the length of the base, the front section supporting a material simulating a green and the rear section embodying two sections one of which sections includes a mounting for a pillar, a sleeve rotatable on the pillar, a captive ball secured to said sleeve, a cable winding drum rotatable by said sleeve, a cable anchored at one end to the winding drum, a tension member in said second section of the rear section, one end of which tension member is anchored therein and the other end secured to the other end of the cable so that upon the captive ball being struck by a golf club the cable is wound upon the drum against the resistance of the tension member and upon the captive ball expending its energy the retraction of the tension member unwinds the cable from the drum, and with an indicator in said second section movable by said cable as it is wound upon the drum and arranged to remain in an indicating position after the cable has been unwound from the drum by the tension member.

7. A golf practising device as claimed in claim 6 wherein the pillar is bolted to the floor of the section forming part of the rear section of the base, said pillar having a head to retain the sleeve on the pillar and with said sleeve having the winding drum formed thereon.

8. A golf practising device as claimed in claim 6 and wherein said one end of the cable anchored to one side of the winding drum and extends along the first base section over a return pulley into the second base section where it is secured to the one end of the tension member, said indicator being carried by a block movable in said second section.

9. A golf practising device as claimed in claim 6 and wherein the said second section forms a guideway for the indicator, and aperture in the indicator through which the cable passes, a block on the cable to move the indicator in one direction as the cable is wound upon the drum, and one or more resilient arms on the indicator to frictionally engage the guideway to thereby retain the indicator in an indicating position and permit it to be manually returned to a normal or zero position.

10. A golf practising device as claimed in claim 9 and wherein one wall of the guideway is provided with a slot, a pointer on said indicator projecting through said slot to register with indicia adjacent said slot.

* * * * *